United States Patent [19]

Howell

[11] 4,001,622

[45] Jan. 4, 1977

[54] DIRECTIONAL SOURCES OF ELECTROMAGNETIC RADIATION

[75] Inventor: Michael L. Howell, Park End, near Lydney, England

[73] Assignee: Rank Xerox, Ltd., London, England

[22] Filed: Oct. 3, 1974

[21] Appl. No.: 511,823

[52] U.S. Cl. ..... 313/113; 219/216; 219/343; 219/347; 240/103 B; 250/317

[51] Int. Cl.[2] ..... H01J 5/16; H05B 1/00

[58] Field of Search ..... 219/216, 343, 388, 347, 219/349, 354, 461, 464; 313/113, 114; 240/103 B, 103 R, 41.35 R; 250/316–319

[56] References Cited

UNITED STATES PATENTS

| | | | |
|---|---|---|---|
| 606,792 | 7/1898 | Quidas | 313/113 X |
| 2,234,987 | 3/1941 | Soller | 240/103 R X |
| 2,247,409 | 7/1941 | Roper | 313/113 X |
| 2,839,673 | 6/1958 | Wilcoxon | 240/103 R X |
| 3,005,081 | 10/1961 | Kordes et al. | 219/343 X |
| 3,436,524 | 4/1969 | Pauls | 219/347 |
| 3,475,589 | 10/1969 | Bartusek et al. | 219/216 |
| 3,718,497 | 2/1973 | Rice | 219/464 X |
| 3,805,024 | 4/1974 | Joeckel et al. | 219/354 X |

*Primary Examiner*—C. L. Albritton

[57] ABSTRACT

A convenient reflecting material is a ceramic fiber felt in which the container is partially embedded, the felt being bleached by the radiation from the source to form a pure white reflector conforming to the exterior of the container. The ceramic fiber felt is virtually indestructable, and costs only a few pence. The felt can be made sufficiently thick that the reflector acts as a heat insulator so that heat losses to the back of the reflector are low. The time for the system to warm-up is dependent almost entirely on the source and its enclosing tube, as little heat passes into the reflector.

2 Claims, 2 Drawing Figures

DIRECTIONAL SOURCES OF ELECTROMAGNETIC RADIATION

BACKGROUND OF THE INVENTION

This invention relates to directional sources of electromagnetic radiation. In order to direct the electromagnetic radiation efficiently, it is usual to provide a reflector on one side of the source so that the object to be irradiated receives radiation from the source directly and also by means of the reflector indirectly. In order to focus radiation from a line source, the reflector should be elliptical with the line source at one focus and the object to be irradiated at the other focus: if a parallel beam of radiation is required, the reflector should be parabolic with the line source located at the focus of the parabola. Other reflector configurations can be used as required, but all such arrangements require reflectors which are accurately formed and accurately located with respect to the source.

The present invention achieves this object by providing an electromagnetic radiation source mounted within a container transparent to the radiation of the source, the container being partially embedded in a reflecting material. The shape of the container then controls the shape of the reflecting surface of the material, and its location relative to the source. The relative location of the source and the container is controlled at the time of manufacture, and the possibility of error when the reflector is shaped and the radiation source is mounted relative to the reflector is much reduced.

In xerographic copying machines, a photoconductive plate in the form of a drum passes sequentially a plurality of xerographic processing stations, as follows:

A charging station, at which a uniform electrostatic charge is deposited on the photoconductive layer of the xerographic drum; An exposure station, at which a light or radiation pattern of copy to be reproduced is projected onto the drum surface to dissipate the drum charge in the exposed thereof and thereby form a latent electrostatic image of the copy to be reproduced; A developing station, at which a xerographic developing material including toner particles having an electrostatic charge opposite to that of the electrostatic latent image are cascaded over the drum surface, whereby the toner particles adhere to the electrostatic latent image to form a xerographic powdered image in the configuration of the copy being reproduced; A transfer station, at which the xerographic powder image is electrostatically transferred from the drum surface to a transfer material or support surface; and, A drum cleaning and discharge station, at which the drum surface is brushed to remove residual toner particles remaining thereon after image transfer, and at which the drum surface is exposed to a relatively bright light source to effect substantially complete discharge of any residual electrostatic charge remaining thereon.

Immediately subsequent to the image transfer station, there is positioned a stripping apparatus for removing the sheets of support material from the drum surface. This device, which is of the type disclosed in U.S. Pat. No. 3,062,536, includes a plurality of small diameter orifices supplied with pressurized aeriform fluid by a suitable pulsator or other device. The pulsator is adapted to force jets of pressurized aeriform fluid through the outlet orifices into contact with the surface of the xerographic drum slightly in advance of the sheet of support material to strip the leading edge of the sheet from the drum surface and to direct it onto an endless conveyor whereby the sheet material is carried to a fixing device. At the fixing device, the transferred xerographic powder image on the sheet of support material is permanently fixed or fused thereto as by heat. After fusing, the reproduction is discharged from the apparatus at a suitable point for connection externally of the apparatus by means of the conveyor.

It is important that the heat from the fuser is sufficient to cause all the toner to fuse onto the paper but insufficient to cause the paper to char. Since transferred images only pass through the fuser for a small proportion of the operating time of the apparatus, it is important in the interests of fuel economy to provide a fuser which can quickly be brought up to the operating temperature, but which has a lower stand-by temperature. Earlier types of fuser uses an open wound element with a centre quartz support rod. This has a very long warm-up time, mainly due to the thermal mass of the support rods. It has a reflector, but the reflector tends to absorb or transmit nearly half of the heat produced, so that a high power fuser is required to provide the desired heat. Another type of fuser is the roll where the paper carrying the transferred powder image passes between two rollers, one of which is heated. Although this system has the advantage that fusing is assisted by the pressure between the rollers, it has the disadvantage of high cost and a very long warm-up time and possible distortion of the toner by contact with one roller.

Container tubes enclosing a source of electromagnetic radiation have been used in fusers of electrostatic copying machines, but with separate reflectors. The separate reflectors have to have reflecting surfaces of expensive material as gold, and these surfaces tend to deteriorate with use. Heat losses through the reflector are high, so that the part of the machine behind the reflector becomes undesirably hot.

BRIEF SUMMARY OF THE INVENTION

A convenient reflecting material is a ceramic fibre felt in which the container is partially embedded, the felt being bleached by the radiation from the source to form a pure white reflector conforming to the exterior of the container. The ceramic fibre felt is virtually indestructable, and costs only a few pence. The felt can be made sufficiently thick that the reflector acts as a heat insulator so that heat losses to the back of the reflector are low. The time for the system to warm-up is dependent almost entirely on the source and its enclosing tube, as little heat passes into the reflector.

DESCRIPTION OF THE DRAWINGS

An example of the invention will now be described with reference to the accompanying drawings in which.

DETAILED DESCRIPTION OF THE INVENTION

Figure 1:
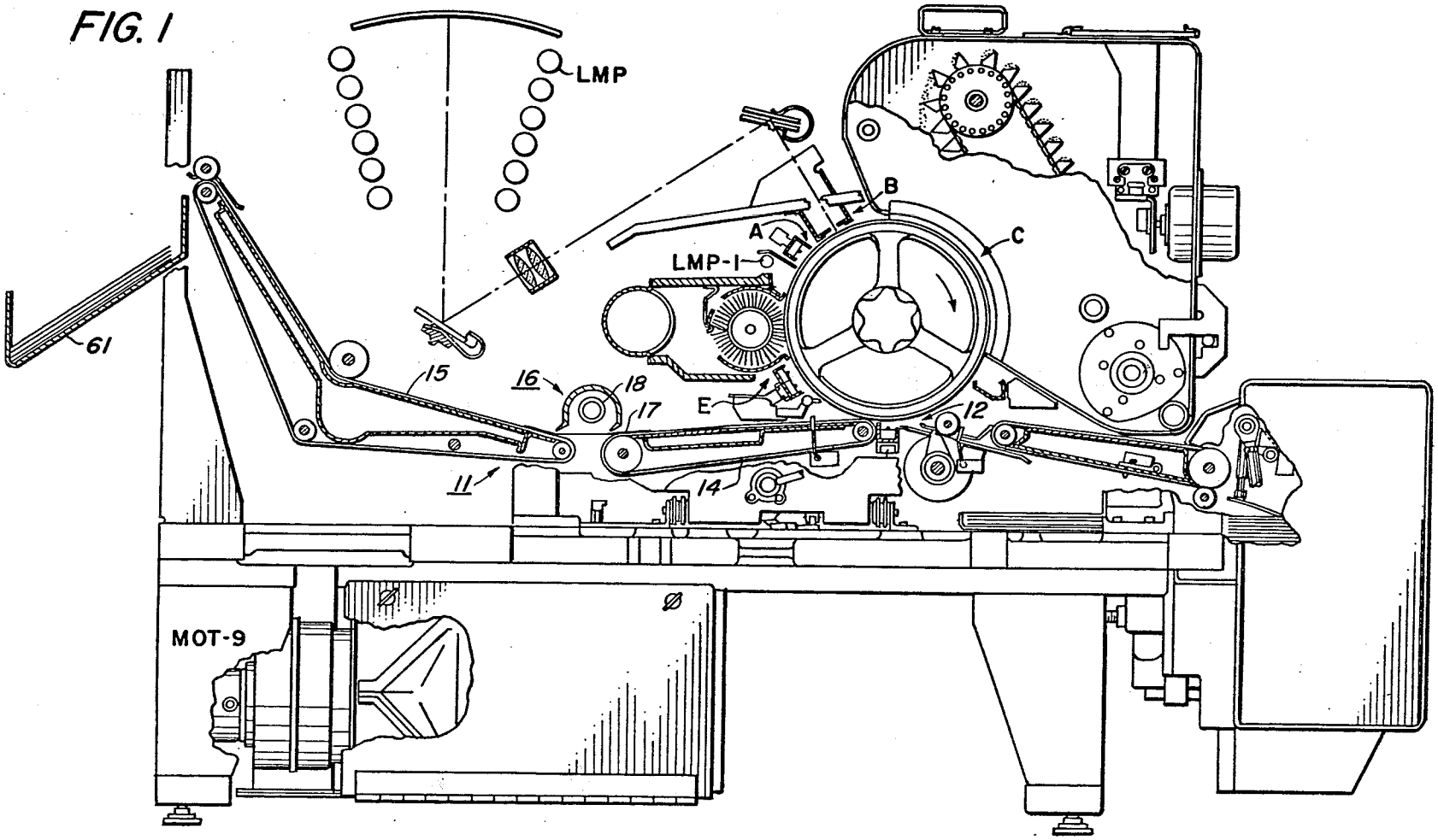
FIG. 1 is a diagrammatic representation of a xerographic copying machine.

The xerographic copying machine of FIG. 1 is, with the exception of the fuser, similar to that described in U.S. Pat. No. 3,512,885 and its basic xerographic processing stations have been set out earlier in this specification. The fuser is shown in greater detail in FIG. 2.

Figure 2:
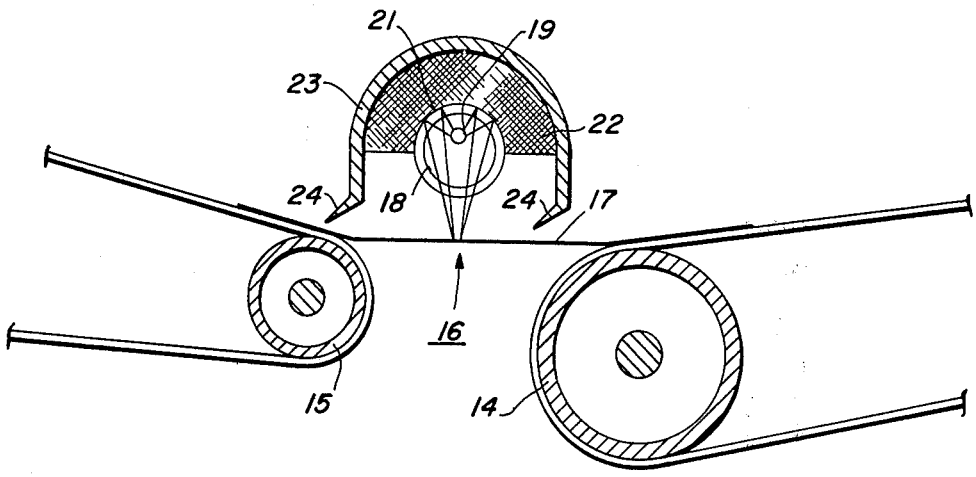
FIG. 2 is a section through the fuser of such a copying machine.

The conveyor system 11 for carrying the sheets of paper from the transfer station 12 at the bottom of the drum 13 includes two vacuum transport systems 14 and 15 and the transported sheet passes from the first system 14 to the second system 15 at the fuser station 16. The vacuum transport systems are conventional, and a system similar to those described in the aforementioned U.S. patent. As can be seen in FIG. 2, the transported sheet 17 is carried on top of the vacuum systems 14 and 15 and at the fuser station 16 passes below a cylindrical quartz tube 18 within which is located a linear filament 19 which can be energized to produce heat radiation. There is a gap between the systems 14 and 15 at the fuser station, so that heat is not wasted in heating up the transport systems, but is used efficiently to heat the sheet 17.

The rear portion 21 of the tube is embedded in a ceramic fibre felt 22 of fairly uniform thickness, the thickness of the felt being approximately equal to the dimension across the tube 18. The outside of the felt is supported by a metal shield 23 of semi-circular configuration, the open mouth of the shield facing the paper path. The edges of the mouth of the shield 23 have tapered portions 24 inclined in the direction of the paper path in order to guide sheets from the vacuum transport away from the inside of the shield 23 in order to avoid excessive heating of a mis-fed sheet.

The cylindrical tube 18 and consequent cylindrical shape of the reflecting felt causes the radiation from the top of the filament 19 to be roughly focused on the sheet 17. For true focussing the back portion 21 of the tube should be elliptical with the filament 19 at one focus and the sheet 17 at the other. The cylindrical shape is more convenient and for paraxial rays the formula $1/p + 1/q = 1/F = 2/R$ gives a true focus where $p$ and $q$ are the distances of the filament 19 and sheet 17 from the back 21 of the tube 18, $F$ is the focal length of the curved outer surface of the quartz tube and $R$ is the tube radius. The formula does not apply for off-axis rays but it is not necessary for the radiation from the filament 19 to be accurately focused on the paper path. The paper and the image carried thereon will absorb radiation falling upon it from the element irrespective of its concentration, and in the interests of efficiency, the criterion is that as high a proportion as possible of radiation from the filament 19 which does not pass directly through the tube 18 to the paper should be reflected by the fibre felt around the outside of the tube 18 so that it is directed towards the paper at a not-too-high angle of incidence in order that the radiation will be absorbed.

When the tube 18 is first embedded in the felt, the felt becomes bleached to form a pure white reflector which conforms to the exterior of the tube. For a standard high wattage infrared tubular quartz bulb with a colour temperature of about 2200° C, the surface of the felt is heated up to about 500° C which causes bleaching. The bleached surface of the felt forms a reflector which, although not as good at reflecting as some metals, is consistent in its reflecting power and is cheap and accurate to produce.

What is claimed is:

1. An electromagnetic radiation source mounted within a container transparent to the radiation of the source;

a reflecting material within which the container is partially embedded, said reflecting material comprising a ceramic fiber felt material;

a shield on the side of the reflecting material remote from the container;

said shield defining a mouth opening in one direction, through which the radiation can pass, both edges of the shield being inclined in a second direction inclined to said first direction so as to guide material passing across said mouth out of said mouth.

2. Apparatus according to claim 1 wherein said container comprises a tube.

* * * * *